US008668288B2

(12) United States Patent
Salice

(10) Patent No.: US 8,668,288 B2
(45) Date of Patent: Mar. 11, 2014

(54) SELF-CLOSING AND OPENING DEVICE PARTICULARLY FOR A MOVABLE FURNITURE PART

(76) Inventor: Luciano Salice, Carimate (IT)

( * ) Notice: Subject to any disclaimer, the term of this patent is extended or adjusted under 35 U.S.C. 154(b) by 109 days.

(21) Appl. No.: 13/120,573

(22) PCT Filed: Sep. 28, 2009

(86) PCT No.: PCT/EP2009/006970
§ 371 (c)(1),
(2), (4) Date: Mar. 23, 2011

(87) PCT Pub. No.: WO2010/043306
PCT Pub. Date: Apr. 22, 2010

(65) Prior Publication Data

US 2011/0254416 A1 Oct. 20, 2011

(30) Foreign Application Priority Data

Oct. 13, 2008 (IT) ..... MI08A001812
Oct. 17, 2008 (IT) ..... MI08A001849

(51) Int. Cl.
*A47B 95/00* (2006.01)

(52) U.S. Cl.
USPC ..... 312/333; 312/319.1; 312/334.1; 312/329; 312/109

(58) Field of Classification Search
USPC ..... 312/333, 319.1, 326, 330.1, 331, 334.1, 312/334.44, 222, 329, 109
See application file for complete search history.

(56) References Cited

U.S. PATENT DOCUMENTS 3,854,785 A * 12/1974 Manner et al. ..... 312/319.1
5,474,375 A * 12/1995 Hollenstein et al. ..... 312/319.1
6,846,053 B2 * 1/2005 Salice ..... 312/334.14

(Continued)

FOREIGN PATENT DOCUMENTS

WO 2006/058351 A1 6/2006
WO WO 2006066774 A1 * 6/2006
WO 2008/071168 A1 6/2008

OTHER PUBLICATIONS

International Search Report of the International Searching Authority dated Dec. 17, 2009.

(Continued)

*Primary Examiner* — Daniel Rohrhoff
(74) *Attorney, Agent, or Firm* — Amster, Rothstein & Ebenstein LLP

(57) ABSTRACT

The self-closing and opening device (1) particularly of a movable furniture part (103) comprises a fixed guide (8) having a supporting body (2) in which a first slider (3) can slide reversibly along a sliding axis (100) in opposition to and through the action of first elastic means (5), the first slider (3) being engageable with first driving means (106) present on a driving element (6) which slides reversibly in the direction of the sliding axis (100), the supporting body (2) comprising first movement means (4) for movement of the first slider (3) suitable to engage with guide means (12, 13) of the first slider (3), so as to release it from the driving means (106), also provided with a mechanical or elastically yielding stop (9, 120) against which the first slider (3) rests directly or indirectly before it engages with the guide means (12,13) in the first movement means (4) the driving element (6) being then pushed by an ejector (20) generating an initial opening movement of said movable furniture part (103).

15 Claims, 5 Drawing Sheets

(56) References Cited

U.S. PATENT DOCUMENTS

| | | | | |
|---|---|---|---|---|
| 7,399,041 | B2 * | 7/2008 | Prentner et al. | 312/333 |
| 7,748,800 | B2 * | 7/2010 | Compagnucci | 312/333 |
| 7,854,485 | B2 * | 12/2010 | Berger | 312/333 |
| 7,887,147 | B2 * | 2/2011 | Karg | 312/319.2 |
| 8,235,478 | B2 * | 8/2012 | Zimmer et al. | 312/333 |
| 2006/0214548 | A1 * | 9/2006 | Lam et al. | 312/332 |
| 2006/0238089 | A1 * | 10/2006 | Prentner et al. | 312/333 |
| 2007/0103041 | A1 * | 5/2007 | Kropf et al. | 312/333 |
| 2007/0114896 | A1 * | 5/2007 | Orita | 312/334.14 |
| 2007/0222346 | A1 * | 9/2007 | Kleinsasser | 312/205 |
| 2008/0100189 | A1 * | 5/2008 | Huber | 312/319.1 |
| 2009/0230830 | A1 * | 9/2009 | Ng | 312/333 |
| 2011/0156561 | A1 * | 6/2011 | Salice | 312/319.1 |
| 2011/0210653 | A1 * | 9/2011 | Salice | 312/319.1 |
| 2011/0215690 | A1 * | 9/2011 | Juan et al. | 312/319.1 |

OTHER PUBLICATIONS

Written Opinion of the International Searching Authority dated Dec. 17, 2009.

* cited by examiner

SELF-CLOSING AND OPENING DEVICE PARTICULARLY FOR A MOVABLE FURNITURE PART

FIELD OF THE INVENTION

The present invention relates to a self-closing device, in particular of a movable furniture part, such as a part that slides or swings about horizontal or vertical axes.

SUMMARY OF THE INVENTION

The subject-matter of the present invention can also be adopted for general doors for houses or the like.

As it is known, devices have been present on the market for some time to more or less automatically open and/or close movable furniture parts, such as a door or a drawer of a piece of furniture.

By way of example, to open a drawer of a piece of furniture a device known as catch is currently used, substantially provided with a pushing element which is released by slight pressure and, when released, under an elastic force, gives the drawer a push which determines controlled movement thereof capable of allowing the user to grasp the drawer to perform total opening thereof, especially if it has no handle.

On the contrary, to perform closing of a drawer a self-closing device is used, normally associated with the fixed guide of the drawer and having a supporting body for a slider which is movable inside a groove produced in this body.

Normally, the slider moves in the groove in opposition to and through the action of a spring and is activated by a driving element which is integral with the extractable guide of the drawer. Opening of the drawer causes activation of the self-closing device which, when the drawer is closed again, in the last part of travel thereof, takes control of it, for example through a pin, and returns it to the fully closed position by means of the spring.

Normally, a decelerator also operates in cooperation with the self-closing device, which dampens closing of the drawer reducing the impact that would occur as a result of the closing spring thereof.

In the light of the above, it can easily be understood how complicated it is to combine an automatic opening system with a self-closing system of the movable furniture part as, normally, the forces at play of the catch and of the self-closing device tend to oppose each other, preventing either opening or closing thereof.

For this reason, systems which are sometimes extremely complicated have been designed, which for this purpose also make use of parts moved by electric motors in order to overcome the forces at play and allow more or less automatic opening and closing, albeit partial, of the movable furniture part.

At times these solutions are somewhat ineffective as, besides making the device extremely complicated, they tend not to operate constantly in time, require continuous maintenance and have high costs, which makes their use unsuitable for certain types of furniture.

In the case in which the movable part is composed of a drawer, the self-closing device can be positioned without distinction, for example, on the guides for movement thereof. Instead, in the case of doors that swing by means of hinges, the device must preferably be placed on the part of the piece of furniture opposite the part on which the hinges are positioned, i.e. in which with external pressure exerted by the user it is possible to achieve a movement of the door sufficient to operate the device. Opening of the door takes place with the edge thereof moving completely away from the side on which it was resting, and consequently interaction between the driving element and the slider of the self-closing system is more complicated.

Moreover, hinges of different types are available on the market, in particular integrated with an elastic device for pushing the door in the closing direction, optionally aided by a deceleration device, or equipped with an elastic device for pushing the door in the opening direction, usually to combine with the catch devices described previously.

The technical aim of the present invention is therefore to produce a self-closing device of a movable furniture part which allows elimination of the aforesaid drawbacks of prior art.

Within this technical aim, an object of the invention is to produce a self-closing device in particular of a movable furniture part which can be combined with an opening system thereof and which is reliable and extremely simple to operate, ensuring the long-term effectiveness thereof without requiring for this purpose any type of ordinary or special maintenance.

Another object of the invention is to produce a self-closing device of a movable furniture part which can be easily mounted even by unskilled workers, so that it can also be replaced or adjusted by the user in the case of need and which, moreover, has a low cost so as to promote widespread use on the market.

Yet another object of the invention is to produce a self-closing device of a movable furniture part which can be mounted on any type of furniture occupying a limited space.

The technical aim and these and other objects according to the present invention are achieved by producing a self-closing device in particular of a movable furniture part in conformity with the appended claim 1.

Moreover, other features of the present invention are defined in the dependent claims.

Further features and advantages of the invention will be more apparent from the description of preferred but non-exclusive embodiments of the self-closing device of a movable furniture part according to the invention, illustrated by way of non-limiting example in the accompanying drawings, wherein:

DETAILED DESCRIPTION OF PREFERRED EMBODIMENTS

Figure 1:
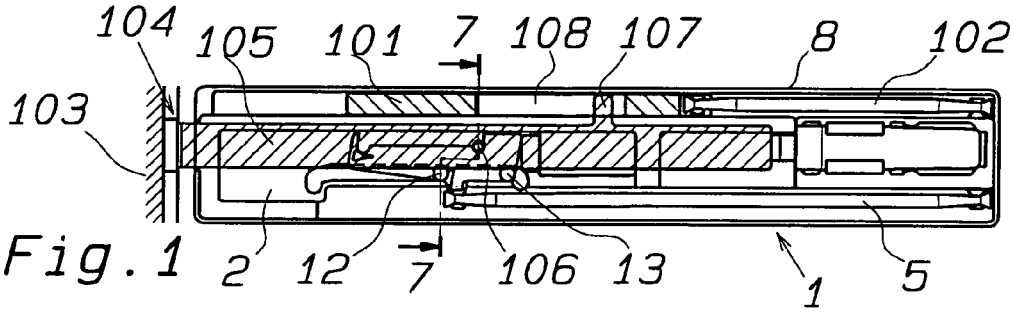
FIG. 1 shows a plan view of the device according to a first preferred embodiment of the present invention with the driving element in the initial position with the door closed.

In the description, the same reference numbers are used to represented equivalent parts.

With reference to the first preferred embodiment of the invention shown in FIGS. 1-12.

There is shown a self-closing device for a movable furniture part, according to the invention, indicated as a whole with the reference number 1.

The movable furniture part 103 to which this embodiment specifically refers is a door that swings with respect to the body of the piece of furniture, but it could also more generally be a drawer or similar parts. Moreover, as mentioned, the invention could also be applied to the field of general doors for houses or the like.

The device 1 is preferably associated with a fixed guide 8 fastened to the static part 116 of the piece of furniture and having a supporting body 2 for a first slider 3 which moves reversibly in the direction of a sliding axis 100 between a rear end and a front end of a groove 4 in opposition to and through the action of first elastic means, in particular a first spring 5.

The groove 4 extends rectilinearly in the direction of the sliding axis 100.

The first slider 3 is engageable by first driving means present on a driving element 6 which moves reversibly in the direction of the sliding axis 100 between a position retracted in the fixed guide 8 and a position extracted from the fixed guide 8.

In the area of the rear end thereof, the groove 4 comprises first means for movement of the first slider 3 transverse to the sliding axis 100 suitable to engage with specific guide means of the first slider 3.

Moreover, in the area of the front end thereof, the groove 4 comprises second means for movement of the first slider 3 transverse to the sliding axis 100 suitable to engage with the guide means of the first slider 3.

The first movement means comprise an intermediate side cavity 10 and a rear curve 11 of the groove 4. Instead, the second movement means comprise a front curve 14 of the groove 4 which extends from the same part of the groove 4 in which the intermediate side cavity 10 and the rear curve 11 are located. The guide means in turn comprise a front guide pin 12 and a rear guide pin 13.

The front guide pin 12 and respectively the rear guide pin 13 are suitable to engage in the intermediate side cavity 10 and respectively in the rear curve 11 of the groove 4, and the front guide pin 12 is alternatively suitable to engage also in the front curve 14 of the groove 4.

The first slider 3 comprises a rear surface slot 109 and a front surface slot 110 in which a driving pin 106 engages selectively.

The rear slot 109 and the front slot 110 respectively have side walls 111 and 112 projecting with respect to the separation surface 113 between the front slot 109 and the rear slot 110 to intercept the driving pin 106.

In particular, the separation surface 113 is flat and the side walls 111 and 112 project beyond the plane of the separation surface 113.

The device 1 is also provided with an elastically yielding stop 9, fixed to the supporting body 2, against which the first slider 3 rests directly or indirectly before it engages with the guide means thereof in the first movement means of the groove 4.

The stop 9, having a main axis oriented in the direction of the sliding axis 100, comprises a fixed part **9*a* and a movable part 9*b* between which a spring (not shown) is interposed, advantageously having greater elastic strength than that of the first spring 5 so that, when the first slider 3 is free to slide, it is capable of stopping it in the position corresponding to the closed position of the movable part 103**.

The device 1 also has means 104 for removable coupling between the movable part 103 and the driving element 6.

The coupling means 104 can indistinctly comprise magnetic or mechanical connection means of known type, for example fitted to the internal side of the movable part 103 and to the front end of the driving element 6.

In the case of magnetic connection, the coupling force exerted by the coupling means must be calibrated so as to allow release thereof as a result of a reasonable force exerted by the user.

In the case of connection of mechanical type, the coupling means must allow separation of the elements in the extracted position of the driving element 6.

In a first preferred embodiment, in which the device is applied to a piece of furniture provided with hinges which exert a push in the closing direction of the movable part 103, a second slider 101 is also provided, carried by the fixed guide 8 and which moves reversibly in the direction of the sliding axis 100 in opposition to and through the action of second elastic means, in particular a second spring 102.

The second slider 101 is engageable with second driving means 107 present on the driving element 6. In this case the coupling force of the coupling means must be greater than the sum of the elastic return force towards the retracted position exerted indirectly on the driving element 6 by the first and second elastic means, and in particular by the first spring 5 and by the second spring 102.

The driving element 6 has a rod-shaped main body 105 and is supported slidingly in a guide element 114 produced in a cover 115 of the fixed guide 8. The axis of the rod-shaped main body 105 extends in the direction of the sliding axis 100.

The first driving means of the driving element 6 comprise a driving pin 106 which extends transversely to the rod-shaped main body 105 and is suitable to engage with the first slider 3.

The second driving means of the driving element 6 comprise a tab 107 which extends laterally from the rod-shaped main body 105 and is constrained to slide in a guide slot 108 produced in the second slider 101.

Finally, the device 1 has an ejector 20 supported in the fixed guide 8 behind the driving element 6. The ejector 20, which comprises a fixed part 20*a* containing a movable spindle 20*b*, is suitable to act against the rear base of the rod-shaped body 105 to generate an initial opening movement of the movable part 103 with a force greater than the force exerted thereon by any independent closing devices, such as those integrated in the hinges.

The ejection force exerted by the ejector 20 is however less than the elastic force of the first spring 5.

Advantageously, the ejector 20 is equipped in a known manner with a device for adjusting the pushing force exerted.

The ejector 20 also has a main axis oriented in the direction of the sliding axis 100.

Operation of the device according to the invention appears evident from the description and illustration and, in particular is substantially as follows.

FIG. 1 represents the situation of the device 1 when the movable part 103 is closed.

In the first step in which the movable part 103 is closed and coupled with the driving element 6, the driving pin 106 engages in the rear slot 109 of the first slider 3 which is held in a first idle position in which it rests against the elastically yielding stop 9, the spring of which is not compressed, but only preloaded in order to hold the first slider 3 in position. The rear end of the driving element 6 rests against the head of the ejector 20 which has the spindle 20*b* in retracted position, as the force of the ejector 20 is less than the force of the first spring 5.

Figure 2:
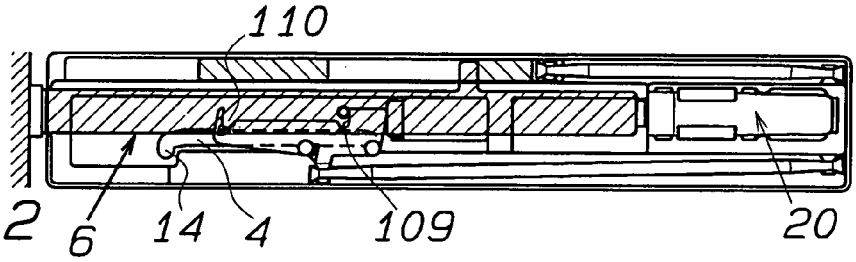
FIG. 2 shows the device according to FIG. 1 with the driving pin disengaged from the rear slot of the first slider.

In the subsequent second step of return of the driving element 6, shown in FIG. 2, the first slider 3 is made to move back into a second position by an external compression force (i.e. generated by the user) of the movable part 103.

In the second position of the first slider 3 the front guide pin 12 and respectively the rear guide pin 13 engage in the intermediate side cavity 10 and respectively in the rear curve 11 of the groove 4. Movement of the first slider 3 transverse to the sliding axis 100 causes the driving pin 106 to disengage from the rear slot 109.

Figure 3:
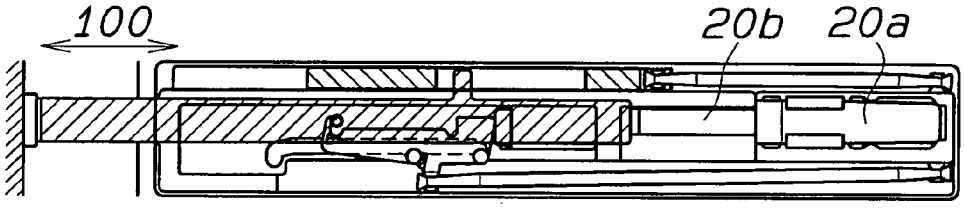
FIG. 3 shows the device of FIG. 1 with the driving pin abutting on the side wall of the front slot of the first slider in the position in which the door has been opened by a quantity suitable to allow the user to grasp it.

In the subsequent third step, shown in FIG. 3, the driving pin 103 is released from the rear slot 109 and the driving element 6, as a result of the push exerted by the ejector 20 and now temporarily no longer opposed by the spring 5 or, naturally, by the user, is extracted to make the movable part 103 perform its initial opening movement which terminates when the driving pin 106 is intercepted by the projecting side wall 112 of the front slot 110 of the first slider 3.

In the first three steps, the tab 107 slides freely in its guide slot 108.

Figure 4:
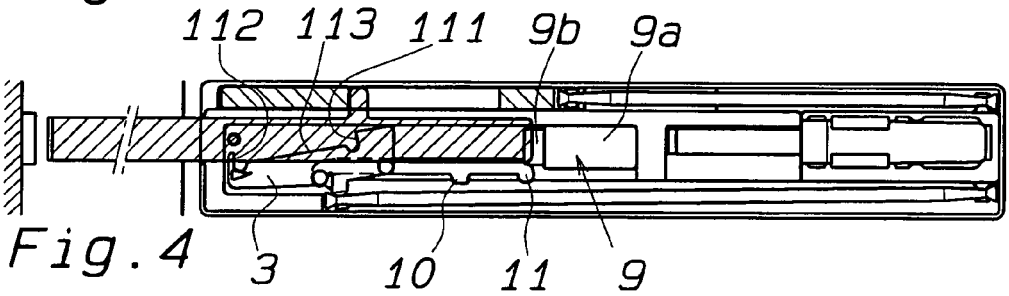
FIG. 4 shows the device of FIG. 1 wherein, through the external action of the user, the driving pin has disengaged from the first slider and the door has been released from the driving element.

In the subsequent fourth step, shown in FIG. 4, as a result of an external pulling force (i.e. generated by the user) on the movable part 103, the driving pin 106, intercepted by the side wall 112 of the front slot 110 of the first slider 3, firstly drives the first slider 3 causing the front 12 and respectively rear 13 guide pin to disengage from the intermediate side cavity 10 and respectively from the rear curve 11 of the groove 4. Movement of the first slider 3 transverse to the sliding axis 100 then causes the driving pin 106 to engage in the front slot 110. During the fourth step, after having come into contact with the front end of the guide slot 108, the tab 107 starts to drive the second slider 101 to the end of its travel in the position in which the front end of the second slider 101 is intercepted by the front wall of the fixed guide 8 and consequently further advance of the driving element 6 is blocked. Before the second slider 101 reaches the ends of its travel, the front guide pin 12 engages with the front curve 14 of the groove 4 making the first slider 3 move transversely to the direction of movement 100, as a result of which the driving pin 106 disengages from the front slot 110. The coupling force ensured by the coupling means is greater than the sum of the return force caused by the first spring 5 and the second spring 102, so that the driving element 6 can be driven forward. When the driving element 6 reaches the end of its travel during extraction, in the case of magnetic connection the pulling force on the movable part 103 becomes predominant with respect to the coupling force ensured by the coupling means, or, in the case of mechanical connection, the coupling means are released from their coupling, the movable part 103 is released from the driving element 6 and can be taken to a position of complete opening.

Figure 5:
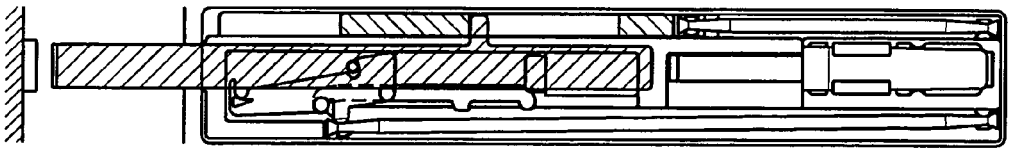
FIG. 5 shows the device of FIG. 1 in the moment in which, during retraction of the driving element, the driving pin impacts against the side wall of the rear slot of the first slider.
Figure 6:
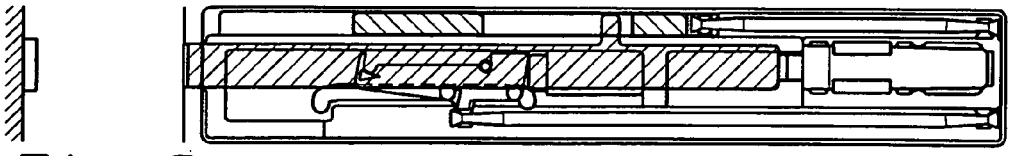
FIG. 6 shows the device of FIG. 1 which, with the door open, shows the driving element back in the initial position.
Figure 7:
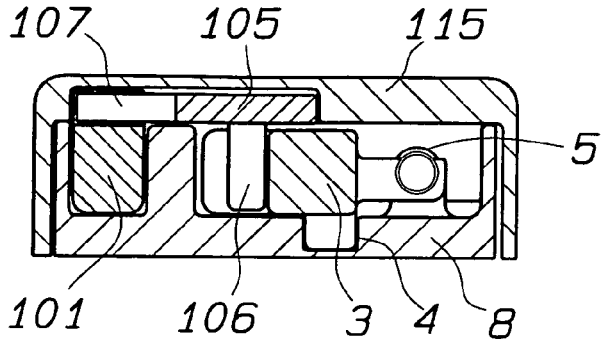
FIG. 7 shows a cross section of the device of FIG. 1 along the line 7-7.
Figure 8:
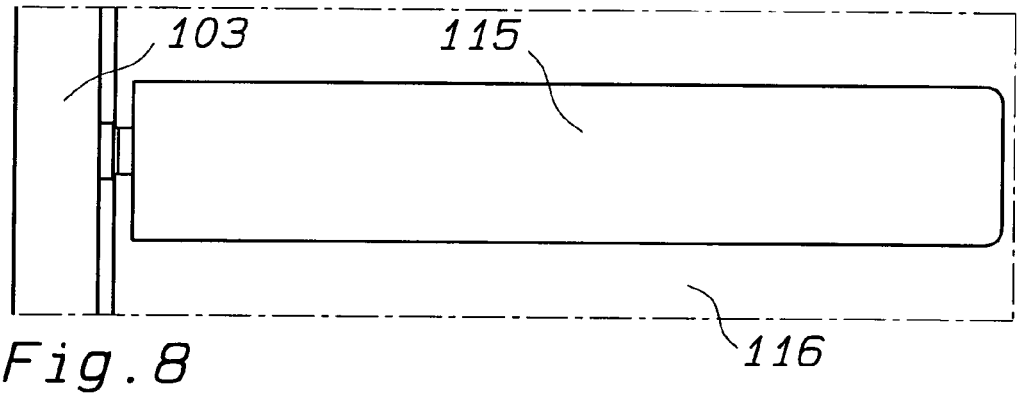
FIG. 8 shows the device of FIG. 1 fitted to the piece of furniture and enclosed in its own cover.
Figure 9:
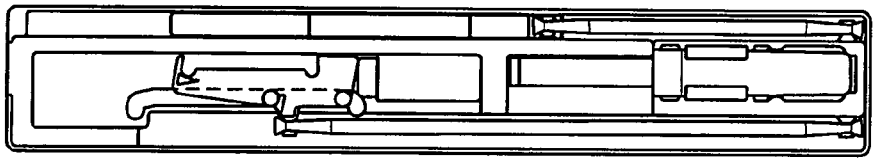
FIG. 9 shows a plan view of the fixed guide of the device of FIG. 1.
Figure 10:
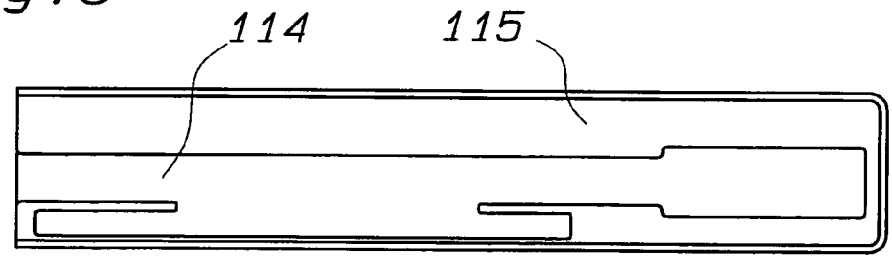
FIG. 10 shows a plan view of the inside of the cover of the fixed guide of the device of FIG. 1.
Figure 11:
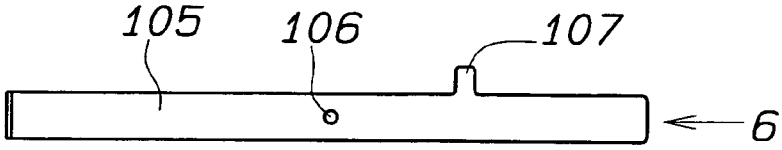
FIG. 11 shows a plan view of the driving element of the device of FIG. 1.
Figure 12:
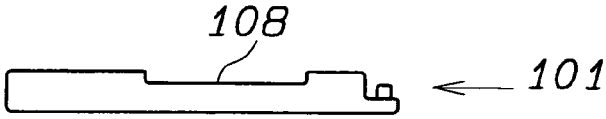
FIG. 12 shows a side view of the second slider of the device of FIG. 1.
Figure 13:
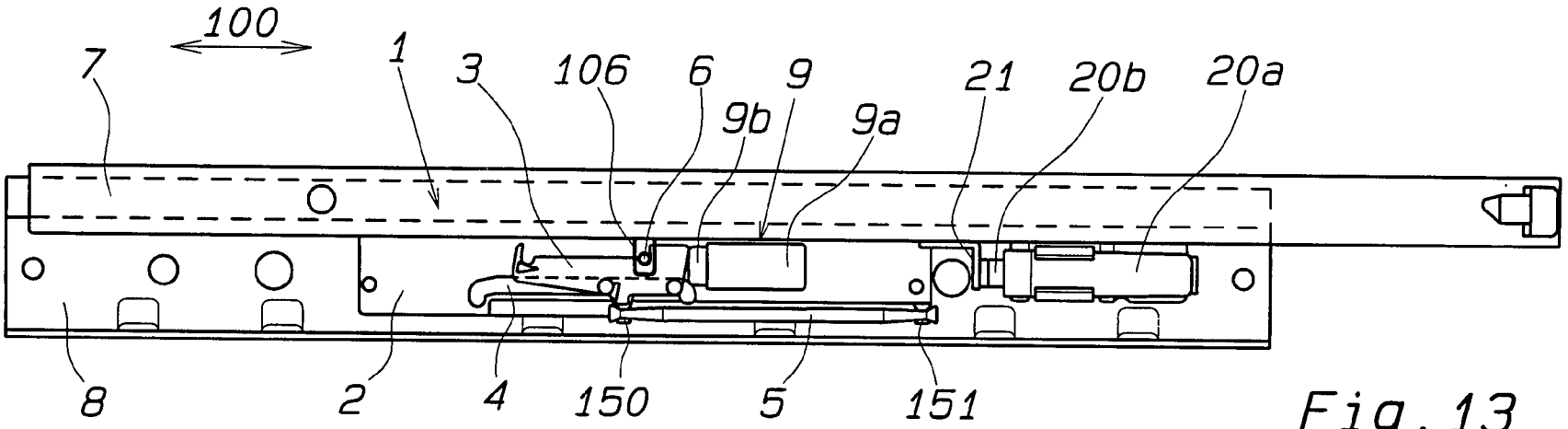
FIG. 13 shows a plan view of the right part of a guide for drawers with the device according to a second preferred manner of producing the present invention.
Figure 14:
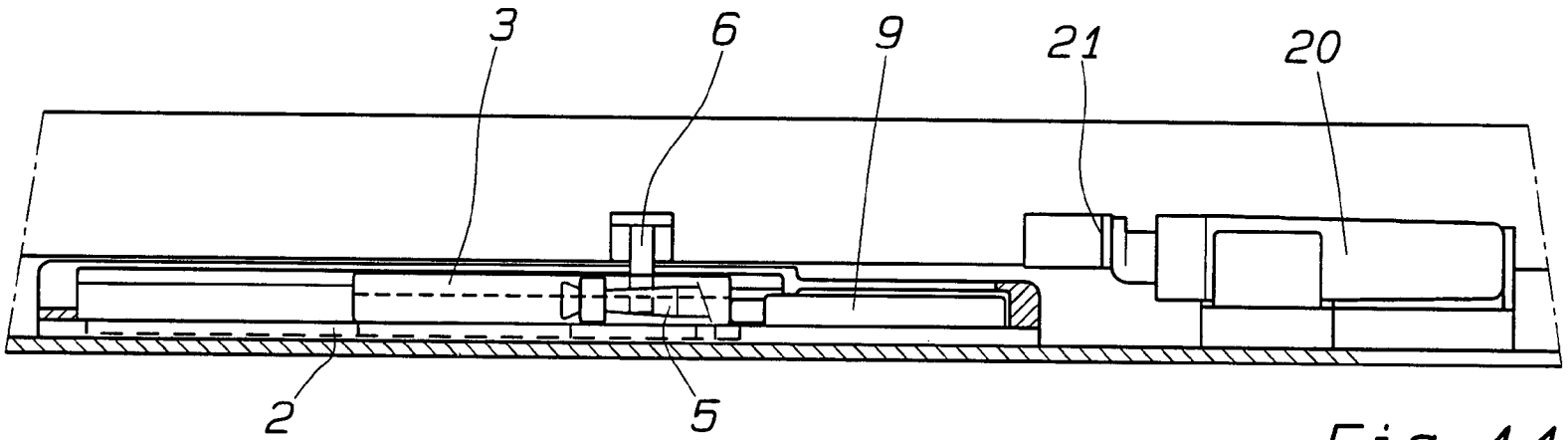
FIG. 14 shows a side elevation in enlarged scale of a portion of the device of FIG. 13.

In the subsequent fifth step, shown in FIG. 5, the second slider 101, through the spring 102, retracts the driving element 6 towards the inside of the fixed guide 8. During this step the driving pin 106, intercepted by the side wall 111 of the rear slot 109, initially causes the first slider 3 to move transversely to the sliding direction 100 and the front guide pin 12 to disengage from the front curve 14. Consequently, also the first slider 3 can be returned, through the spring 5, to the position thereof taken in the first step (FIG. 6).

In the case of a piece of furniture having hinges provided with elastic system with push in the opening direction of the swinging furniture part, it is necessary for the driving element 6 to remain in its extracted position to re-couple the swinging part when it is closed again. Therefore, this type of hinge makes the second slider and the second elastic means superfluous, and allows a decelerator to be provided optionally in place of the ejector to decelerate the closing movement of the swinging part caused by the spring 5 which moves the slider 3 back when it is coupled by the driving element 6. The device therefore allows simple and functional opening and closing of a door or drawer facilitating grasping thereof by the user and providing guided closing thereof.

We shall now refer to the second preferred embodiment of the invention shown in FIGS. 13-20.

There is shown a self-closing device for a movable furniture part, according to the invention, indicated as a whole with the reference number 1. The movable furniture part 103 to which this preferred embodiment specifically refers is a drawer, but it could also more generally be a door that swings with respect to the body of the piece of furniture or similar parts. Moreover, as mentioned the invention could also be applied to the field of general doors for houses or the like. The device 1 comprises, associated with a fixed guide 8, a supporting body 2 for a slider 3 which moves reversibly along a sliding axis 100 in opposition to and through the action of first elastic means, in particular a first spring 5 coupled at one end thereof with a connection 150 produced on an extension of the slider 3 and at the other end thereof with a connection 151 produced on an extension of the supporting body 2.

The slider 3 is engageable with driving means present on a driving element 6 which moves reversibly in the direction of the sliding axis 100 integral with an extractable guide 7 of the drawer to which it is fixed.

However, it would also be possible to associated the supporting body 2 with the extractable guide 7 and the driving element 6 with the fixed guide 8. The supporting body 2 comprises first means for movement of the slider 3 suitable to engage with specific guide means of the slider so as to release it from the driving means.

An elastically yielding stop 9 is also present, against which the slider 3 rests directly or indirectly before it engages with the guide means in the first movement means.

The stop 9, having a main axis oriented in the direction of the sliding axis 100, comprises a fixed part 9*a* and a movable part 9*b* between which a spring (not shown) is interposed, advantageously having greater elastic strength than that of the first spring 5 so that, when the first slider 3 is free to slide, it is capable of stopping it in the position corresponding to the closed position of the movable part 103.

The coupling means comprise a driving pin 106 which extends transversely to the sliding axis 100 and is suitable to engage with the slider 3.

The supporting body 2 has a groove 4 which in the area of the rear end thereof comprises the first means for movement of the slider 3 and in the area of the front end thereof comprises second means for movement of the slider 3 transverse to the sliding axis 100 suitable to engage with the guide means of the slider 3.

The groove extends rectilinearly in the direction of the sliding axis 100.

The first movement means comprise an intermediate side cavity 10 and a rear curve 11 of the groove 4. The second movement means instead comprise a front curve 14 of the groove 4 which extends from the same part of the groove 4 in which the intermediate side cavity 10 and the rear curve 11 are located. The guide means in turn comprise a front guide pin 12 and a rear guide pin 13.

The front guide pin 12 and respectively the rear guide pin 13 are suitable to engage in the intermediate side cavity 10 and respectively in the rear curve 11 of the groove 4, and the front guide pin 12 is alternatively suitable to engage also in the front curve 14 of the groove 4.

The first slider 3 comprises a rear surface slot 109 and a front surface slot 110 in which the driving pin 106 engages selectively.

The rear slot 109 and the front slot 110 respectively have side walls 111 and 112 projecting with respect to the separation surface 113 between the front slot 109 and the rear slot 110 to intercept the driving pin 106.

In particular, the separation surface 113 is flat and the side walls 111 and 112 project beyond the plane of the separation surface 113.

An ejector 20, suitable to move the drawer for initial opening thereof, can be associated with the device.

The ejector 20 is suitable to interact with a stop 21 integral with the extractable guide 7, but its force is lower than the force exerted by the first spring 5.

The ejector 20, which comprises a fixed part 20*a* containing a movable spindle 20*b*, is provided in a known manner with a device to regulate the pushing force exerted, and also has a main axis oriented in the direction of the sliding axis 100.

In a constructional variant, not shown, the ejector can be replaced by an adequate inclination, not shown, of the fixed and/or sliding guides of the drawer, along which it can slide through gravity.

In a further constructional variant the ejector can be replaced by magnets, not shown here, oriented to generate repulsion forces, capable of allowing the drawer to slide and facilitating, as in the other cases, grasping thereof by the user.

Operation of the device according to the invention appears evident from the description and illustration and, in particular is substantially as follows.

Figure 15:
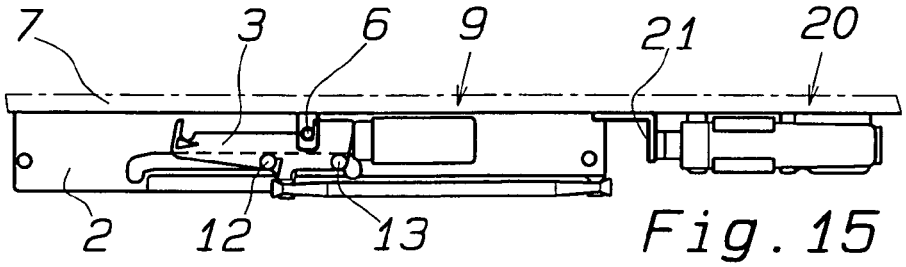
FIG. 15 shows the device of FIG. 13 in a plan view when the drawer (not shown) is in the closed position.

FIG. 15 represents the situation of the device 1 when the drawer is closed. The driving pin 106 engages in the rear slot 109 of the slider 3 which is held in a first idle position in which it rests against the elastically yielding stop 9, the spring of which is not compressed, but only preloaded in order to hold the slider 3 in position. The stop 21 rests against the head of the ejector 20 which has the spindle 20*b* in retracted position, as the force of the ejector 20 is less than the force of the first spring 5.

Figure 16:
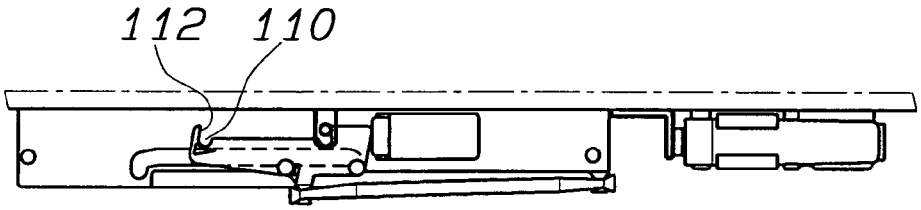
FIG. 16 shows the device according to FIG. 15 after the drawer has been subjected to light pressure which causes it to retract further inside the piece of furniture and causes the slider to move in opposition to the action of the second spring.

In the subsequent step, shown in FIG. 16, the slider 3 is made to move back by an external compression force (i.e. generated by the user) applied to the drawer. In this position of the slider 3 the front guide pin 12 and respectively the rear guide pin 13 engage in the intermediate side cavity 10 and respectively in the rear curve of the groove 4. Movement of the slider 3 transverse to the sliding axis 100 causes the driving pin 106 to disengage from the rear slot 109.

Figure 17:
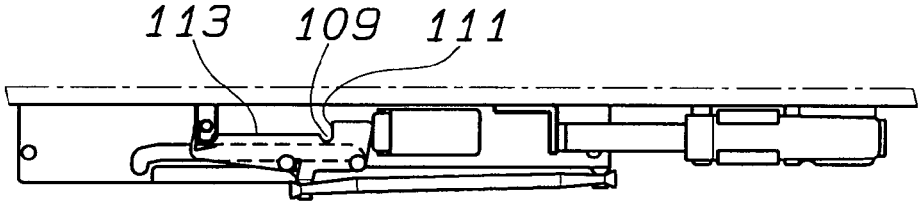
FIG. 17 shows the device of FIG. 13 with the driving pin abutting against the side wall of the front slot of the slider wherein the drawer is open by a quantity to allow it to be grasped by the user.

In the subsequent step, shown in FIG. 17, the driving pin 103 is released from the rear slot 109 and, as a result of the push exerted by the ejector 20 and now temporarily no longer opposed by the spring 5 or, naturally, by the user, it moves to make the drawer perform its initial opening movement which terminates when the driving pin 106 is intercepted by the projecting side wall 112 of the front slot 110 of the slider 3.

Figure 18:
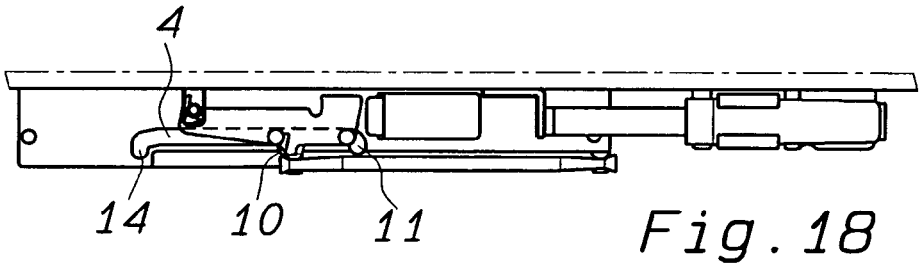
FIG. 18 shows the device of FIG. 13 wherein, through the external action of the user, the driving pin engaged in the front slot of the slider drives it until the guide means are disengaged from the first movement means.

In the subsequent step, shown in FIG. 18, as a result of an external pulling force (i.e. generated by the user) on the drawer, the driving pin 106, intercepted by the side wall 112 of the front slot 110 of the slider 3, firstly drives the slider 3 causing the front 12 and respectively rear 13 guide pin to disengage from the intermediate side cavity 10 and respectively from the rear curve 11 of the groove 4. Movement of the slider 3 transverse to the sliding axis 100 then causes the driving pin 106 to engage in the front slot 110.

Figure 19:
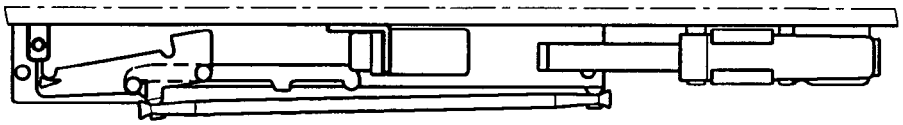
FIG. 19 shows the device of FIG. 13 with the guide means of the slider engaged in the second movement means and the driving pin disengaged from the slider.

During the subsequent step, shown in FIG. 19, the front guide pin 12 engages with the front curve 14 of the groove 4 making the slider 3 move transversely to the direction of movement 100, as a result of which the driving pin 106 disengages from the front slot 110 and proceeds freely to the position of complete opening of the drawer.

Figure 20:
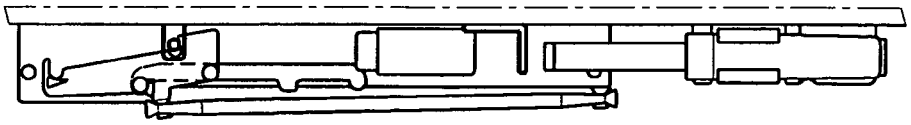
FIG. 20 shows, with reference to the device of FIG. 13, a closing step of the drawer wherein the driving pin is engaged with the side wall of the rear slot of the slider.

In the subsequent closing step, shown in FIG. 20, the drawer is pushed closed by the user. During this step the driving pin 106, intercepted by the side wall 111 of the rear slot 109, initially causes the slider 3 to move transversely to the sliding direction 100 and the front guide pin 12 to disengage from the front curve 14. Consequently, the slider 3 can be returned, through the spring 5, to the position thereof taken in the first step (FIG. 15).

If the entire system requires to be made more compact, the ejector can be housed on the supporting body 2 behind the elastically yielding element.

Moreover, as already seen, inclined guides can take the place of the ejectors, rather than magnets or other systems suitable to move the drawer.

Figure 21:
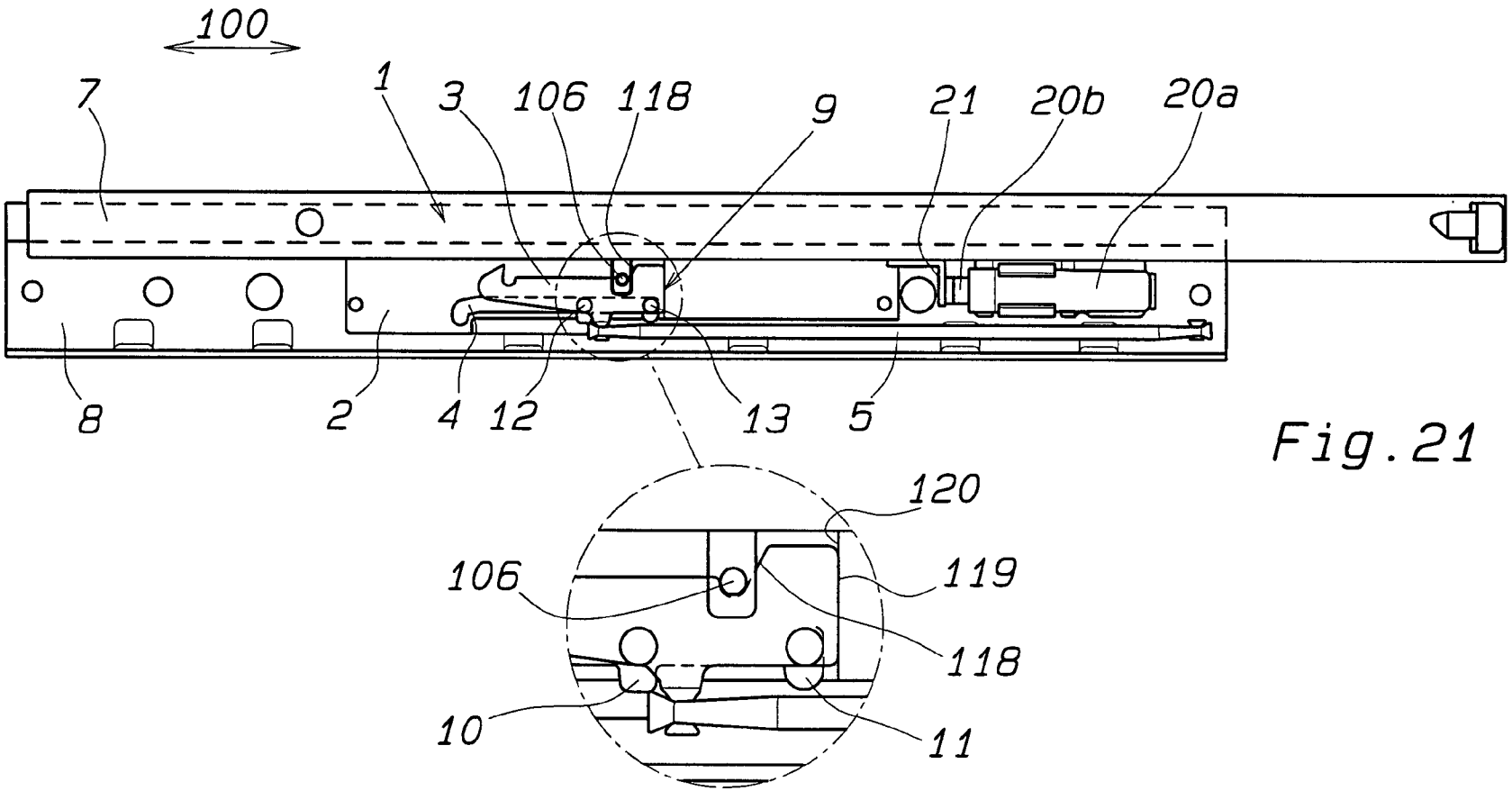
FIG. 21 shows a possible variant of the device according to the invention, wherein the elastically yielding stop has been replaced by a mechanical stop.

With reference now in particular to FIG. 21, the elastically yielding stop 9 is replaced by a mechanical stop formed by a step 120 of the supporting body 2 arranged transversely to the direction of the slider 3. The slider 3 rests with a rear wall 119 thereof against the step 120. By means of a force applied from the outside, on the movable furniture part, the pin 106 integral with the extractable guide 7 is pushed against an inclined surface 118 of the slider 3, which causes lateral movement thereof along the step 120 and inside the appropriate side slots 10, 11 of the groove 4, so that the pin 106 is released and the extractable guide 7 can be pushed to open by the ejector 20*a*, 20*b*.

In practice, it has been seen how the device according to the invention is particularly advantageous to allow simple and functional opening and closing of a drawer facilitating grasping thereof by the user and providing guided closing thereof.

The invention thus conceived is susceptible to numerous modifications and variants, all falling within the scope of the inventive concept; moreover, all details can be replaced by technically equivalent elements.

In practice, the materials used and the sizes can be any according to requirements and to the state of the art.

The invention claimed is:

1. A self-closing device combinable with an opening system thereof for a movable furniture part comprising a fixed guide having a supporting body in which a first slider can slide reversibly along a sliding axis in opposition to and through the action of first elastic means, said elastic means being a returning elastic means that returns the first slider to an initial position in which the movable furniture part is closed, said first slider being engageable with first driving means that is engageable or integral with the movable furniture part, comprising a first driving pin present on a driving element which slides reversibly in the direction of said sliding axis, said supporting body comprising first means for movement of said first slider engageable with guide means of said first slider, so as to release it from said driving means, also provided a mechanical or elastically yielding stop against which said first slider rests directly or indirectly before it engages with said guide means, said supporting body having a groove which in the area of the rear end thereof comprises said first means for movement of said first slider and in the area of the front end thereof comprises second means for movement of said first slider transverse to said sliding axis suitable to engage with said guide means of said first slider, said first slider comprising a rear slot and a front slot in which said driving pin engages selectively, said front slot and said rear slot having a respective side wall projecting with respect to the surface separating said front slot and said rear slot to intercept said driving pin.

2. The self-closing device according to claim 1, wherein said first movement means comprise an intermediate side cavity and a rear curve of said groove.

3. The self-closing device according to claim 2, wherein said second movement means comprise a front curve of said groove arranged on the same part of said groove in which said intermediate side cavity and said rear curve are located.

4. The self-closing device according to claim 2, wherein said guide means comprise a front guide pin and a rear guide pin, said front guide pin and said rear guide pin being suitable to engage in said intermediate side cavity and in said rear curve of said groove, said front guide pin also being suitable alternatively to engage in said front curve.

5. The self-closing device according to claim 1, wherein said driving element is supported slidingly in a guide element produced in a cover of said fixed guide.

6. The self-closing device according to claim 1, wherein it has removable coupling means between said movable furniture part and said driving element.

7. The self-closing device according to claim 1, wherein it comprises a second slider carried by said fixed guide and which slides reversibly in the direction of said sliding axis in opposition to and through the action of second elastic means, said second slider being engageable with second driving means present on said driving element.

8. The self-closing device according to claim 7, wherein said removable coupling means have a coupling force greater than the sum of the elastic return force exerted indirectly on said driving element by said first and second elastic means.

9. The self-closing device according to claim 7, wherein said second driving means comprise a tab which extends transversely from said driving element and is constrained to slide in a guide slot produced in said second slider.

10. The self-closing device according to claim 1, wherein said fixed guide supports, behind said driving element, an ejector suitable to generate an initial opening movement of said movable part.

11. The self-closing device according to claim 10, wherein said ejector has an ejection force that is less than the elastic force of said first elastic means.

12. The self-closing device according to claim 1, wherein said driving element can slide reversibly in the direction of said sliding axis integral with an extractable guide.

13. The self-closing device according to claim 1, wherein the mechanical or elastically yielding stop is an elastically yielding stop, and wherein said first elastic means exert on said slider in contact with said elastically yielding stop an elastic force that is less than the elastic force generated by said elastically yielding stop.

14. The self-closing device according to claim 1, wherein the mechanical or elastically yielding stop is a mechanical stop, and wherein said mechanical stop is formed by a step of said supporting body arranged transversely to the direction of said first slider, in turn resting with a rear wall thereof against said step.

15. The self-closing device according to claim 14, wherein said first slider has an inclined surface against which said driving pin is suitable to be pushed so as to move said first slider laterally along said step.

* * * * *